United States Patent [19]

Biswas

[11] Patent Number: 4,466,785

[45] Date of Patent: Aug. 21, 1984

[54] CLEARANCE-CONTROLLING MEANS COMPRISING ABRADABLE LAYER AND ABRASIVE LAYER

[75] Inventor: Chandi P. Biswas, Rocky Hill, N.J.

[73] Assignee: Ingersoll-Rand Company, Woodcliff Lake, N.J.

[21] Appl. No.: 442,603

[22] Filed: Nov. 18, 1982

[51] Int. Cl.[3] ..... F04C 18/20; F04C 27/00; F16J 15/16

[52] U.S. Cl. ..... 418/152; 418/178; 418/191; 415/174; 29/156.4 WL

[58] Field of Search ..... 418/152, 178, 191; 29/156.4 R, 156.4 WL; 51/26; 415/174

[56] References Cited

U.S. PATENT DOCUMENTS

| | | | |
|---|---|---|---|
| 2,491,678 | 12/1949 | McCullough et al. | 418/152 |
| 2,492,935 | 12/1949 | McCullough et al. | 418/178 |
| 4,227,703 | 10/1980 | Stalker et al. | 415/174 |

FOREIGN PATENT DOCUMENTS

| | | | |
|---|---|---|---|
| 535554 | 4/1941 | United Kingdom | 29/156.4 R |
| 2073324 | 10/1981 | United Kingdom | 418/191 |

*Primary Examiner*—John J. Vrablik
*Attorney, Agent, or Firm*—B. J. Murphy

[57] ABSTRACT

The embodiment depicted comprises a pair of coacting rotors, in a rotary compressor, having interengaging lobes and grooves, the rotors being journaled in intersecting bores in a housing. The circumferential surfaces, and end walls of the bores are polymer-layered, and the rotors carry abrasive to machine the polymer to define an optimum clearance for rotor rotation within the bores, and in coaction together. Each rotor is polymer-coated and abrasive particles are borne in the polymer on the outer edges of the lobes and in discrete radial patterns on the rotor sides. The method defines the polymer-coating and abrasive particles-deposition steps.

13 Claims, 6 Drawing Figures

CLEARANCE-CONTROLLING MEANS COMPRISING ABRADABLE LAYER AND ABRASIVE LAYER

This invention pertains to a method of, and means for controlling a clearance in a machine having a rotary element, and in particular to a novel method and means, of the aforesaid type, which define improvements over the prior art practices.

In the prior art it is known to fix, on a rotary element, a grid or waffle-pattern of soft metal, such as lead, and rotate the element, in interference, with its confronting surface. The latter may be a housing or chamber wall, or the like. In this practice, the raised portions of the soft metal are urged into the intervening recesses of the pattern, upon rotation of the rotary element, thereby to define a substantially uniform surface thereon, and a generally uniform operating clearance between the element and its confronting surface. As a practical matter, however, what results is a rotary element with a soft metal surface with a multiplicity of undulations, the latter defining peaks or ribs with the optimum clearance, and thereadjacent depressions of excess clearance.

It is an object of this invention to set forth a new concept of clearance control, or definition of an optimum clearance, in a machine having a rotary element superior to the known practices. In its exemplary embodiment, and in its method of practice, the invention comprises an abradable-type clearance-controlling arrangement.

This new concept of clearance control is useful for any rotating part in a machine, and machining to substantially zero clearance can be obtained in place. It enables any compressor, pump or motor to have an extremely close tolerance or interference fit between the rotor and the housing thereof, or between two rotors, without any close-tolerance machining during component manufacture and assembly.

This abradable-type clearance-controlling arrangement can be performed by spraying any abradable, cure-to-hard coating having a polymer base, such as an epoxy base, a phenolic resin base, and the like, on one of the surfaces, either the rotating or the stationary one, and depositing single or multiple layers of abrasive particles, such as silicon carbide or aluminum oxide, on the mating, engaging or confronting surfaces. The deposition of abrasive particles is done by first spraying such an aforesaid bond coating of any cure-to-hard polymer base coating also on the surface of the mating part, and then spraying the abrasive particles on top of it while such bond coating is still wet. When the bond coating is cured, the particles become strongly held to the surface and render it very abrasive.

The coatings are normally applied slightly oversize such that, during installation of the so-coated rotary element, a few rotations thereof by hand will machine the coating of the abradable layer to a close tolerance. In the cases where the clearance is required to be set at the operating temperature of the machine, as in the case of a rotary compressor, the abradable coating will be machined in place as the machine, after starting, approaches its steady state temperature, and finally a near zero clearance will be reached at the steady, running temperature. The abradable coating material must be hard enough to be easily abraded at the operating temperature. Soft coatings normally tend to load up the abrading surface, making the grinding or machining totally ineffective. In the cases where the ratio of the volume of coating to be removed to the area of abrading surface is too high, the abrasive particles are sprayed in a discontinuous fashion, e.g., in parallel strips, or in a square grid pattern. The pattern is chosen so that there will be no continuous leakage path between the high pressure and low pressure areas in the subject machine (compressor, pump, etc.) The small recessed areas, within the squares of the grid pattern or between the parallel strips, act as collectors for the abraded debris. Otherwise, if discrete patterning is not used an excessive amount of debris accumulates on the abrading surface, rendering it less effective.

Preferably, both coatings, on the fixed and rotating elements, are applied by spraying; this gives more uniform thickness compared to other methods (e.g., dipping or brushing). The polymers employed for the coatings can be a heat-cured type, or a catalytically-activated room temperature-cured type. The abrasive particles are deposited by air spray, with or without an electrostatic field.

The coating thickness may vary from 0.001 inch to as much as 0.015 inch or more, depending on the requirement. Generally, the thicknesses are chosen to be slightly larger than the optimum machining tolerance. The thickness of the particles- or abrasives-bearing layer is chosen on the basis of the particle size of the abrasive. The bond coating should have a thickness of at least half the average diameter of the particles (or average particle size) to ensure strong bonding of the particles, thereto. The total average thickness, therefore, should be at least the average diameter of the particles.

Any type of abrasive can be chosen providing that the particles thereof have sharp corners and edges. Silicon carbide is preferred because it is inexpensive, it has a very high degree of angularity and, upon fracture, it produces new sharp edges and corners (it is most commonly used in sandpapers).

The particle size of the abrasive is determined by the extent of machining needed. If the amount of polymer to be removed is large and the rate of removal is high (high machine rpm), coarse particles are recommended, as they produce large interparticle spaces or voids that allow the wear debris to recess thereinto, and prevent undesirable surface build up. For small-sized component parts and slow cutting, finer particles should be used. It is to be noted that, the coarser the particles, the more leakage paths are developed from high pressure to low pressure areas in the machine.

It is further a teaching of my invention to use a small range of particle size distribution. Such, being a tighter size distribution, will allow a larger number of particles to machine the confronting polymer surface simultaneously. A larger size distribution may render many particles idle since they will not contact the surface being cut. As illustrated and claimed herein, and to the degree possible, the particles should be of a generally common diameter. Not only will this insure that substantially all of the particles will be in cutting use, but they will effectively buttress each other to inhibit their being dislodged from the layer of polymer in which they are embedded.

Usually, a single layer of abrasive is sufficient to machine any polymer base coating. However, if there is any possibility that the abrasives may cut through the coating and go into the base metal of the rotor, housing, etc., double layers or triple layers of abrasives should be used. For multiple layer deposition, a bond coating must be applied for each layer.

The coatings used according to this invention also protect the metal surfaces of the rotor, housing, etc., from corrosion and chemical attack.

The maximum temperature to be used in application of the polymer base coating is about 450° F., since most of the polymers start to decompose at this temperature. This clearance-controlling teaching, however, is not for universal practice. It is not suitable if the surfaces to be treated are under high compressive loading or high impact loading.

This invention has been successfully used in rotary compressors, each compressor consisting of four rotors of about seven and a half inches in diameter and one inch thick, and comprising two stages. Each stage, then, has two rotors, and each rotor runs with a close clearance across a housing, on both side faces, and also in close clearance to the other rotor and housing on the periphery thereof. The housing, of cast iron, was sprayed with a 0.006 inch thick, air-cured epoxy polyamide base coating (trademark: Matcote 1-830, Matcote Co.), and the steel rotors were also sprayed with a 0.002 inch-thick of same coating as a bond coat. A single layer of two hundred and twenty mesh (about 65 micron or 0.0025) inch silicon carbide abrasive particles were deposited on the rotor surfaces in discrete band forms. The total thickness of the abrasive laden coating on the rotors was about 0.003 inch. The aforesaid coating was chosen because it provides excellent corrosion protection to the respective components in the compressor.

In a preliminary feasibility test, the abrasives on the rotors had machined almost all of the coating on the housing plus about 0.0005 inch of cast iron base metal in some areas. The compressors employing the invention performance tested satisfactorily and, as of this writing, have logged about 3,000 hours of successful endurance testing.

An embodiment of the invention, which practices the novel method, is shown in the accompanying figures, in which.

Figure 1:
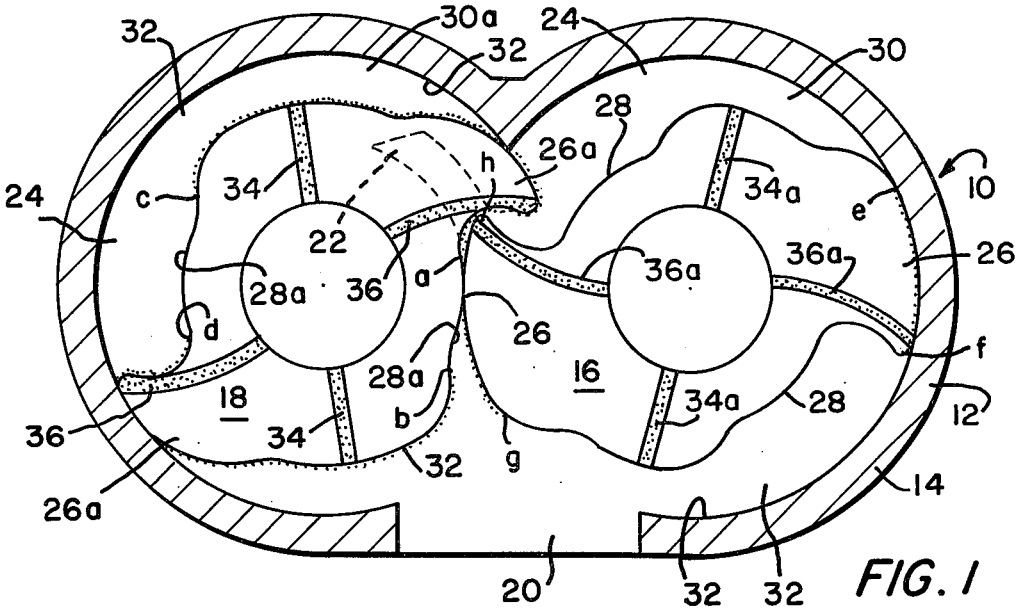
FIG. 1 is an elevational view of a pair of coacting rotors in a rotary compressor, the housing therefor being shown in cross-section.
Figure 2:
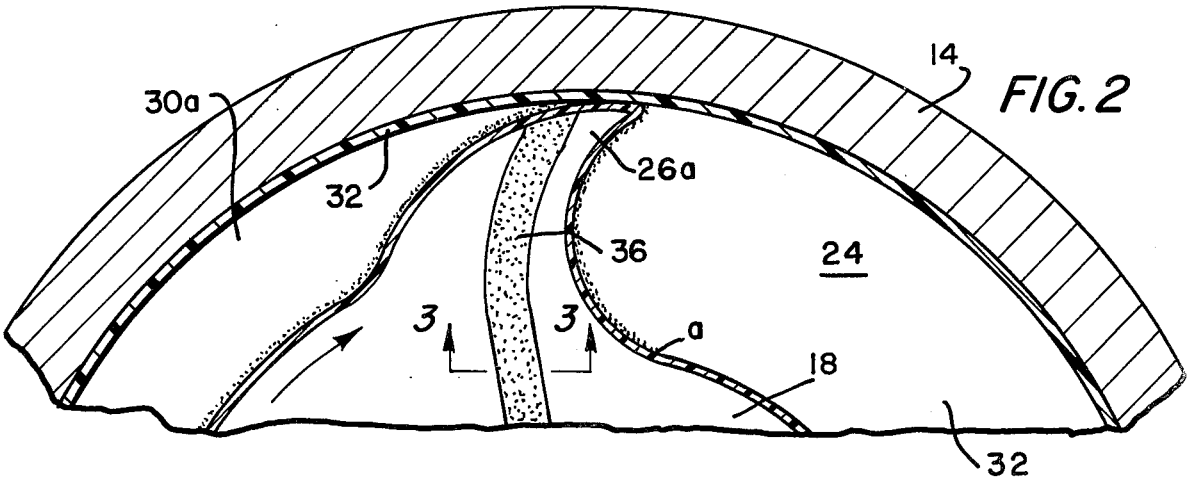
FIG. 2 is a fragmentary view of a portion of the gating rotor, in elevation, and housing, in cross-section.

As shown in the figures, the novel clearance-controlling means 10, according to the depicted, exemplary embodiment, comprises a machine 12, here shown to be a rotary air compressor, having a housing 14 and a pair of rotors 16 and 18. The housing 14 has an inlet 20 and a pair of outlet ports 22 (only one being shown) in the end walls 24 thereof. Rotor 16 is the main rotor; the other, 18, is the gating rotor. Each has a pair of lobes 26 and 26*a*, and a pair of grooves 28 and 28*a*. The rotors are journalled for rotation in their respective, intersecting bores 30 and 30*a*, and each lobe enters and emerges from a groove in the coacting rotor.

The circumferential surface of each bore 30 and 30*a* is layered with a cured, hardened polymer base coating 32, and the end walls 24 likewise bear a layer of the same coating 32. The rotors 16 and 18, also, are layered overall with the same coating 32.

The coating is layered on all the aforesaid surfaces of the bores 30 and 30*a* and rotors 16 and 18 slightly oversized. Hence there is an interference fit between the rotors 16 and 18 and the confronting surfaces of the bores, as well as between the rotors themselves at the operating temperature. The base-metal elemental structure of the rotors 16 and 18, and the walls 24 of the bores, for instance, are manufactured to define a clearance "A" (FIG. 3A) therebetween. After the coating is applied and the parts have reached the operating temperature, the clearance is zero. To define an optimum clearance, then, the invention teaches a machining of the coating on one of two confronting surfaces.

Gating rotor 18, as shown in FIG. 1, for instance, has abrasive particles embedded in the peripheral bond coating 32 thereof, except within the grooves 28*a* thereof between points a and b, and c and d. Also, in substantially radiating swaths 34 and 36, on both sides thereof, rotor 18 has further abrasive particles embedded in the bond coat. Main rotor 16 too has similar radiating swaths 34*a* and 36*a*, on both sides thereof, of abrasive particles. However, on the periphery thereof, the abrasive particles are deposited in the polymer only between points e and f, and g and h, i.e., the radially-outermost portions of rotor 16.

The radiating swaths 34, 34*a*, 36 and 36*a* of abrasive particles, of course, machine the coating 32 on the walls 24 of the bores 30 and 30*a* until an optimum clearance is defined. Similarly, the particles borne on the periphery of the lobes 26 and 26*a* machine the coating 32 on the circumferential surface of the bores, until an optimum clearance is defined.

The areas of the grooves 28*a* of rotor 18, between points a and b, and c and d, have the coating thereon machined by the abrasive particles borne on the outermost lobe surfaces of rotor 16. Conversely, the coating on the periphery of rotor 16, between points f and g, and e and h, is machined to an optimum clearance by the abrasive particles borne on rotor 18 between points a and c, and b and d.

Figure 3:
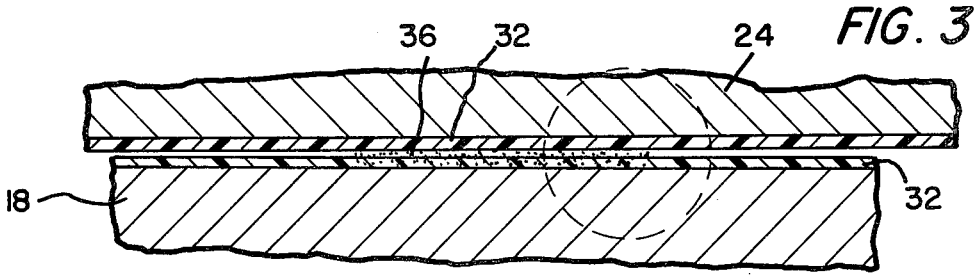
FIG. 3 is a cross-sectional view taken along section 3—3 of FIG. 2.

Should there be some lack of parallelism, between a rotor, such as rotor 18, and an end wall 24 (as shown in FIG. 3), the swaths 34 and 36 will machine the coating on the wall where and as needed, to a true parallelism and the optimum clearance. The layer of polymer coating 32 on the end wall, following machining, may define a thickness "B" which yields an overall clearance "D" between the rotor 18 and the wall 24.

Figure 3A:
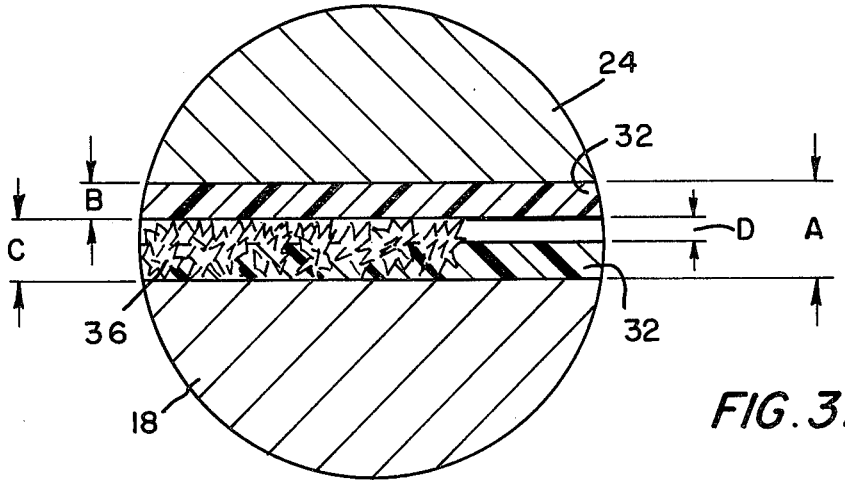
FIG. 3A is an enlarged depiction of the circled area in FIG. 3.

The particles, as shown in FIG. 3A, have a given, general size "C", and the layer 32 of polymer base coating, on rotor 18, in which they are deposited has a thickness of at least half that of the particles size.

Figure 4:
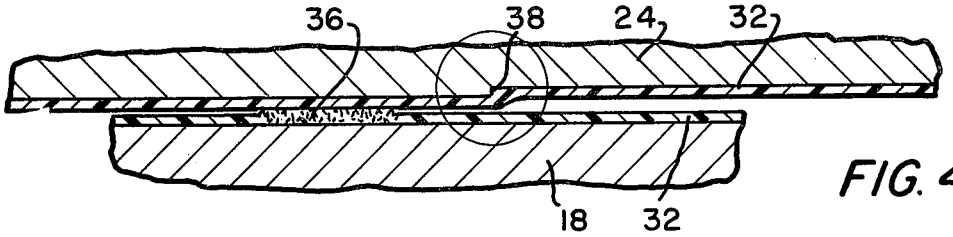
FIG. 4 is a view similar to that of FIG. 3.
Figure 4A:
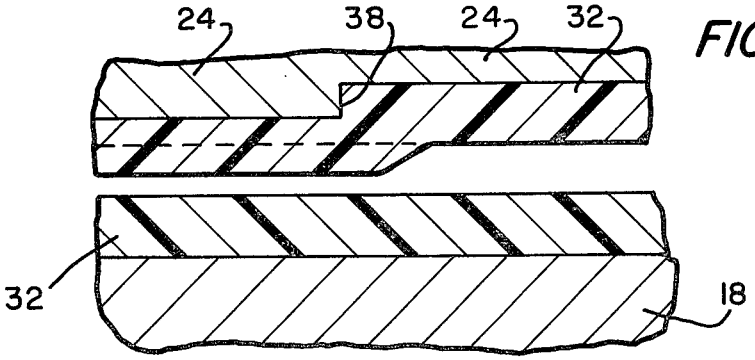
FIG. 4A is an enlarged illustration of the circled area in FIG. 4.

It can happen that, during manufacture, an end wall 24 will be formed with a sharp discontinuity 38. When the wall is layered, then, with a coating 32, a corresponding discontinuity or step will form in the coating (FIGS. 4 and 4A). In these circumstances also, the discontinuity or step will simply be machined away by the swaths 34 and 36 (of rotor 18). The dashed line in FIG. 4A denotes the machining depth which the swaths will achieve.

While I have described my invention in connection with a specific embodiment thereof, and a specific method of its practice, it is to be clearly understood that this is done only by way of example and not as a limitation to the scope of my invention as set forth in the objects thereof and in the appended claims.

I claim:

1. Clearance-controlling means, in a machine having a rotary element, comprising:

a machine having a housing;

said housing having a chamber formed therein;

said chamber having a circumferential surface bounded by a pair of spaced-apart end walls;

a given rotor mounted for rotation within said chamber;

said rotor having a radial lobe for sweeping about said circumferential surface in close proximity to said surface; and said surface and said lobe each having means fixed thereon cooperatively defining an interface therebetween with a single, uniform clearance; wherein said means comprises a pair of layers of material, one of said layers being fixed to said lobe, and the other being fixed to said surface;

one of said layers comprises an abradable material, and the other of said layers comprises an abrasive material;

said abrasive material comprises particles;

said particles have a generally common diameter, each thereof buttressing, and being buttressed by, the others thereof; and substantially all of said particles cooperate to define a substantially uniform abrasive surface.

2. Clearance-controlling means, according to claim 1, wherein:

said rotor has opposite sides which confront said end walls for rotatably planing across said walls in close proximity to said walls; and each of said sides and each of said walls have prescribed means fixed thereon cooperatively defining interfaces, between each said side and each said wall confronted thereby, of a uniform clearance; wherein said prescribed means comprises first coatings of material fixed to said walls, and second coatings of material fixed to said sides; and one of said first and second coatings comprises an abradable material, and the other of said first and second coatings comprises an abrasive material.

3. Clearance-controlling means, according to claim 1, wherein:

said layer fixed to said lobe comprises said abrasive material.

4. Clearance-controlling means, according to claim 2, wherein:

said second coatings fixed to said sides comprise said abrasive material.

5. Clearance-controlling means, according to claim 4, wherein:

said abrasive material is in a plurality of discrete patterns on both sides of said rotor.

6. Clearance-controlling means, according to claim 5, wherein:

said patterns comprise substantially radially-oriented depositions of said abrasive material.

7. Clearance-controlling means, according to claim 4, wherein:

said second coatings further comprise a polymer containing material; and said abrasive material is partially embedded in said polymer containing material.

8. Clearance-controlling means, according to claim 7, wherein:

said polymer containing material has a thickness of not less than half said diameter.

9. Clearance-controlling means, according to claim 1, wherein:

said chamber has a pair of intersecting bores;

said given rotor is mounted for rotation in one of said bores; and further including a second rotor mounted for rotation in the other of said bores; wherein said second rotor has a radial lobe;

each of said rotors has a radial groove formed therein, to accommodate an intermeshing, near-contacting engagement of said lobe of said given rotor with said groove of said second rotor, and said lobe of said second rotor with said groove of said given rotor; and one of said given and second rotors has a layer of said abrasive material fixed to a major portion of the periphery thereof.

10. Clearance-controlling means, according to claim 9, wherein:

said radial groove of said one rotor has an intermediate portion thereof with a convex surface; and said intermediate portion is devoid of said abrasive material.

11. Clearance-controlling means, according to claim 9, wherein:

the other of said given and second rotors has a layer of said abrasive material fixed only on the radially outermost surface thereof.

12. Clearance-controlling means, according to claim 9, wherein:

the other of said given and second rotors has a layer of polymer coating fixed on the full periphery thereof.

13. Clearance-controlling means, according to claim 9, wherein:

said one rotor has a layer of polymer coating fixed on the full periphery thereof.

* * * * *